US009330683B2

(12) United States Patent
Suzuki et al.

(10) Patent No.: US 9,330,683 B2
(45) **Date of Patent: *May 3, 2016**

(54) APPARATUS AND METHOD FOR DISCRIMINATING SPEECH OF ACOUSTIC SIGNAL WITH EXCLUSION OF DISTURBANCE SOUND, AND NON-TRANSITORY COMPUTER READABLE MEDIUM

(75) Inventors: Kaoru Suzuki, Kanagawa-ken (JP); Masaru Sakai, Tokyo (JP); Yusuke Kida, Kanagawa-ken (JP)

(73) Assignee: KABUSHIKI KAISHA TOSHIBA, Tokyo (JP)

( * ) Notice: Subject to any disclaimer, the term of this patent is extended or adjusted under 35 U.S.C. 154(b) by 968 days.

This patent is subject to a terminal disclaimer.

(21) Appl. No.: 13/232,491

(22) Filed: Sep. 14, 2011

(65) Prior Publication Data

US 2012/0232895 A1 Sep. 13, 2012

(30) Foreign Application Priority Data

Mar. 11, 2011 (JP) ..... 2011-054758

(51) Int. Cl.

| | |
|---|---|
| ***G10L 21/02*** | (2013.01) |
| ***G10L 25/84*** | (2013.01) |
| *G10L 21/0208* | (2013.01) |

(Continued)

(52) U.S. Cl.

CPC ..... *G10L 25/84* (2013.01); *G10L 21/0208* (2013.01); *G10L 21/0232* (2013.01); *G10L 25/18* (2013.01); *G10L 2021/02166* (2013.01)

(58) Field of Classification Search

CPC ..... G10L 15/20; G10L 21/0208; G10L 2021/02166

USPC ..... 704/226, 233

See application file for complete search history.

(56) References Cited

U.S. PATENT DOCUMENTS 5,550,924 A * 8/1996 Helf et al. ..... 381/94.3
6,035,048 A * 3/2000 Diethorn ..... 381/94.3

(Continued)

FOREIGN PATENT DOCUMENTS

JP 2001-344000 12/2001
JP 2003-271191 9/2003

(Continued)

OTHER PUBLICATIONS

Office Action of Notice of Reasons for Refusal for Japanese Patent Application No. 2011-054758 Dated Jul. 18, 2014, 4 pgs.

*Primary Examiner* — Jialong He

(74) *Attorney, Agent, or Firm* — Amin, Turocy & Watson LLP; Gregory Turocy

(57) ABSTRACT

According to one embodiment, an apparatus for discriminating speech/non-speech of a first acoustic signal includes a weight assignment unit, a feature extraction unit, and a speech/non-speech discrimination unit. The weight assignment unit is configured to assign a weight to each frequency band, based on a frequency spectrum of the first acoustic signal including a user's speech and a frequency spectrum of a second acoustic signal including a disturbance sound. The feature extraction unit is configured to extract a feature from the frequency spectrum of the first acoustic signal, based on the weight of each frequency band. The speech/non-speech discrimination unit is configured to discriminate speech/non-speech of the first acoustic signal, based on the feature.

7 Claims, 11 Drawing Sheets

(51) Int. Cl.

| | |
|---|---|
| *G10L 25/18* | (2013.01) |
| *G10L 21/0216* | (2013.01) |
| *G10L 21/0232* | (2013.01) |

(56) References Cited

U.S. PATENT DOCUMENTS

| | | | | |
|---|---|---|---|---|
| 6,339,758 | B1 * | 1/2002 | Kanazawa et al. | 704/226 |
| 6,671,667 | B1 * | 12/2003 | Chandran et al. | 704/233 |
| 6,826,528 | B1 * | 11/2004 | Wu et al. | 704/226 |
| 7,333,618 | B2 * | 2/2008 | Shuttleworth et al. | 381/57 |
| 7,359,504 | B1 * | 4/2008 | Reuss et al. | 379/406.02 |
| 2003/0040908 | A1 * | 2/2003 | Yang et al. | 704/233 |
| 2004/0078200 | A1 * | 4/2004 | Alves | 704/233 |
| 2004/0102967 | A1 * | 5/2004 | Furuta et al. | 704/226 |
| 2005/0071159 | A1 * | 3/2005 | Boman et al. | 704/233 |
| 2006/0053007 | A1 * | 3/2006 | Niemisto | 704/233 |
| 2006/0184363 | A1 * | 8/2006 | McCree et al. | 704/233 |
| 2006/0253283 | A1 * | 11/2006 | Jabloun | 704/233 |
| 2007/0150261 | A1 * | 6/2007 | Ozawa | 704/200.1 |
| 2008/0059164 | A1 * | 3/2008 | Furuta et al. | 704/226 |
| 2008/0243496 | A1 * | 10/2008 | Wang | 704/226 |
| 2009/0076813 | A1 * | 3/2009 | Jung et al. | 704/233 |
| 2009/0281805 | A1 * | 11/2009 | LeBlanc et al. | 704/233 |
| 2010/0100386 | A1 * | 4/2010 | Yu | 704/270 |
| 2011/0238417 | A1 | 9/2011 | Yamamoto et al. | |
| 2012/0232890 | A1 * | 9/2012 | Suzuki et al. | 704/226 |

FOREIGN PATENT DOCUMENTS

| | | |
|---|---|---|
| JP | 2005-084253 | 3/2005 |
| JP | 2011-002535 | 1/2011 |

* cited by examiner

APPARATUS AND METHOD FOR DISCRIMINATING SPEECH OF ACOUSTIC SIGNAL WITH EXCLUSION OF DISTURBANCE SOUND, AND NON-TRANSITORY COMPUTER READABLE MEDIUM

CROSS-REFERENCE TO RELATED APPLICATION

This application is based upon and claims the benefit of priority from Japanese Patent Application No.2011-054758, filed on Mar. 11, 2011; the entire contents of which are incorporated herein by reference.

FIELD

Embodiments described herein relate generally to an apparatus and a method for discriminating a speech, and a computer readable medium for causing a computer to perform the method.

BACKGROUND

As to a speech discrimination used as preprocessing of a speech recognition, it is required that a user's speech is correctly detected from various disturbance sounds such as a road-noise of an automobile or a system sound (For example, a beep sound, a guidance speech) uttered by a system. For example, as a speech discrimination method that robustness for the system sound is raised, by specifying a frequency band including a main power of the system sound, when a feature is extracted from an acoustic signal, a frequency spectrum of the frequency band is excluded. By this method, the feature excluding an influence of the disturbance sound (system sound) can be extracted.

However, in this method, when a frequency band to be excluded is determined, a frequency spectrum of the system sound is only used. Accordingly, if a main element of a user's speech is included in the same frequency band as the system sound, when the frequency band including a main element of the system sound is excluded, the main element of the user's speech is also excluded. As a result, an accuracy to discriminate speech/non-speech falls.

DETAILED DESCRIPTION

According to one embodiment, an apparatus for discriminating speech/non-speech of a first acoustic signal includes a weight assignment unit, a feature extraction unit, and a speech/non-speech discrimination unit. The weight assignment unit is configured to assign a weight to each frequency band, based on a frequency spectrum of the first acoustic signal including a user's speech and a frequency spectrum of a second acoustic signal including a disturbance sound. The feature extraction unit is configured to extract a feature from the frequency spectrum of the first acoustic signal, based on the weight of each frequency band. The speech/non-speech discrimination unit is configured to discriminate speech/non-speech of the first acoustic signal, based on the feature.

Various embodiments will be described hereinafter with reference to the accompanying drawings.

(The First Embodiment)

A speech discrimination apparatus of the first embodiment is used for preprocessing of the speech recognition, and it is discriminated whether a user's speech (as a recognition target) is included in each section (having a predetermined length) divided from an acoustic signal. The speech discrimination apparatus acquires a first acoustic signal and a second acoustic signal. The first acoustic signal is acquired via a main microphone located near the user. The second acoustic signal is acquired via a sub microphone. The sub microphone is relatively located at a position farer than the main microphone from the user. Based on a positional relationship between two microphones, the first acoustic signal mainly includes the user's speech, and the second acoustic signal mainly includes a disturbance sound.

By using an amplitude of a frequency spectrum of the first and second acoustic signals, the speech discrimination apparatus assigns a weight to each frequency band. In the first embodiment, a small weight is assigned to a frequency band having not the user's speech but the disturbance sound, and a large weight is assigned to other frequency bands. Then, the speech discrimination apparatus extracts a feature from the first acoustic signal by excluding the frequency band to which the small weight is assigned. In this way, by using the amplitude of the frequency band of the first and second acoustic signals, the weight is assigned to each frequency band. As a result, when the feature is extracted from the first acoustic signal, it is prevented that a frequency spectrum of the frequency band including the main element of the user's speech is excluded.

(Block Component)

Figure 1:
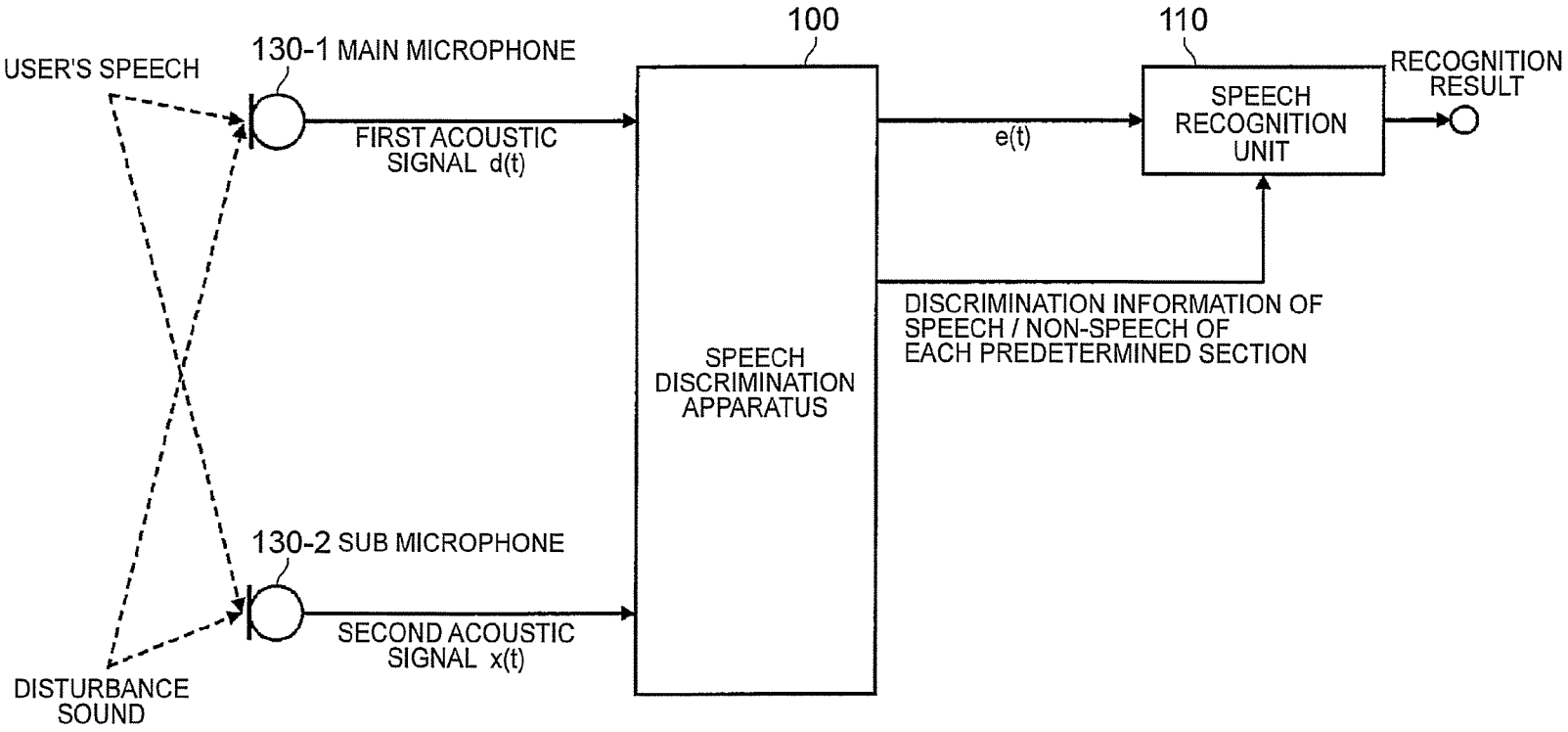
FIG. 1 is a block diagram of a speech recognition system according to a first embodiment.

FIG. 1 is a block diagram of a speech recognition system including a speech discrimination apparatus of the first embodiment. The speech recognition system includes a main microphone 130-1, a sub microphone 130-2, the speech discrimination apparatus 100, and a speech recognition unit 110. The main microphone 130-1 is located near a user. The sub microphone 130-2 is relatively located at a position farer than the main microphone 130-1 from the user. The speech discrimination apparatus 100 discriminates speech/non-speech of a first acoustic signal acquired from the main microphone 130-1. The speech recognition unit 110 recognizes an acoustic signal e (t) (t: index) output from the speech discrimination apparatus 100 (using a discrimination result of speech/non-speech).

In the first acoustic signal d(t) acquired via the main microphone 130-1 and the second acoustic signal x (t) acquired via the sub microphone 130-2, both a user's speech and a disturbance sound are included. However, by a location position thereof, the user's speech is largely included in the first acoustic signal, and the disturbance sound is largely included in the second acoustic signal.

The speech discrimination apparatus 100 divides the first acoustic signal into each section having a predetermined length, and discriminates whether the user's speech is included in each section. Furthermore, the speech discrimination apparatus 100 outputs the first acoustic signal d(t) (as it is) to the speech recognition unit 110.

The speech recognition unit 110 specifies the user's speech section (between a start point and an end point) from discrimination information of speech/non-speech of each section (output by the speech discrimination apparatus 100), and executes speech recognition of the acoustic signal e(t).

Figure 2:
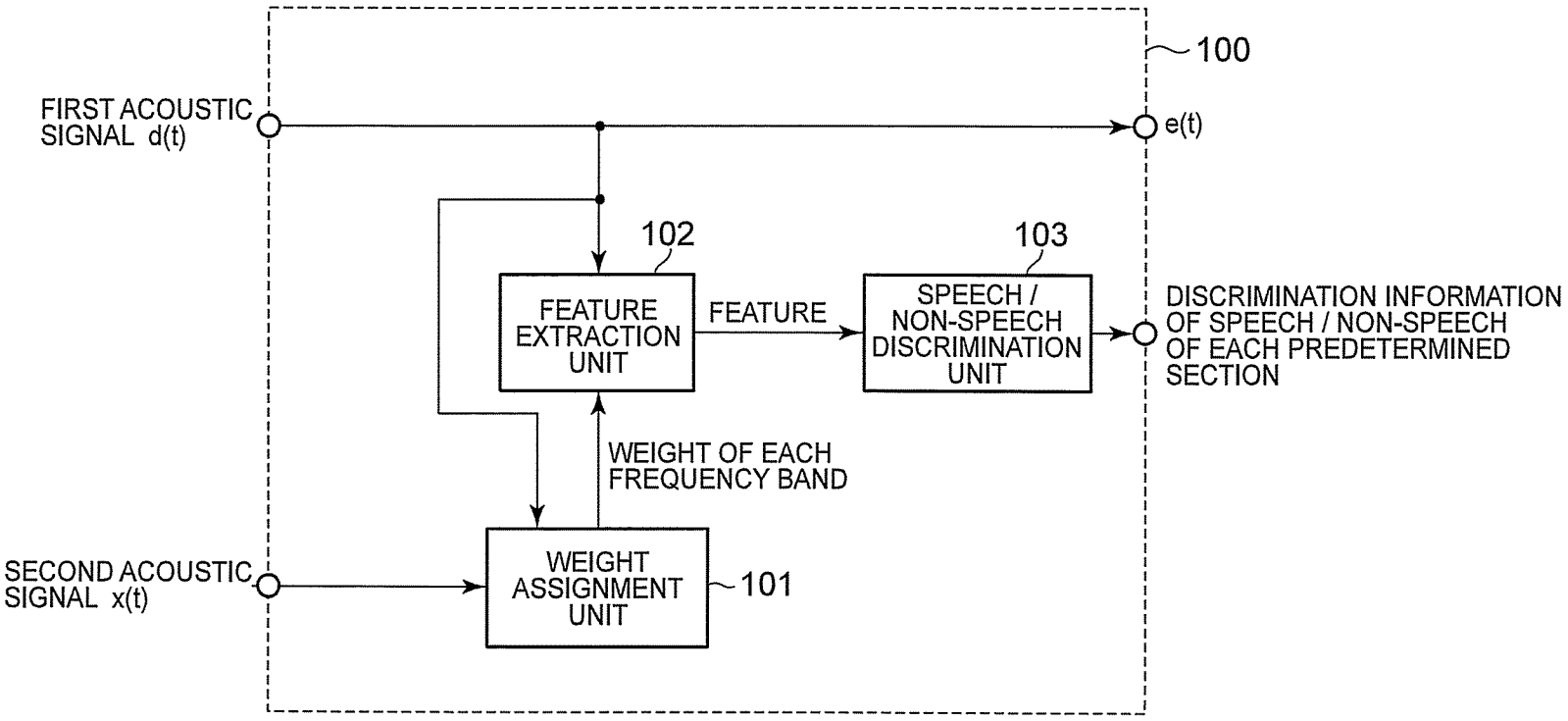
FIG. 2 is a block diagram of a speech discrimination apparatus according to the first embodiment.

FIG. 2 is a block diagram of the speech discrimination apparatus 100. The speech discrimination apparatus 100 includes a weight assignment unit 101, a feature extraction unit 102, and a speech/non-speech discrimination unit 103. The weight assignment unit 101 assigns a weight "0" to a frequency band (a main frequency band of disturbance) having a high probability that includes not a main element of the user's speech but a disturbance sound, and assigns a weight "1" to other frequency bands. The feature extraction unit 102 extracts a feature from the first acoustic signal by excluding a frequency spectrum of the main frequency band of disturbance. The speech/non-speech discrimination unit 103 discriminates speech/non-speech of each section using the feature extracted by the feature extraction unit 102.

(Flow Chart)

Figure 3:
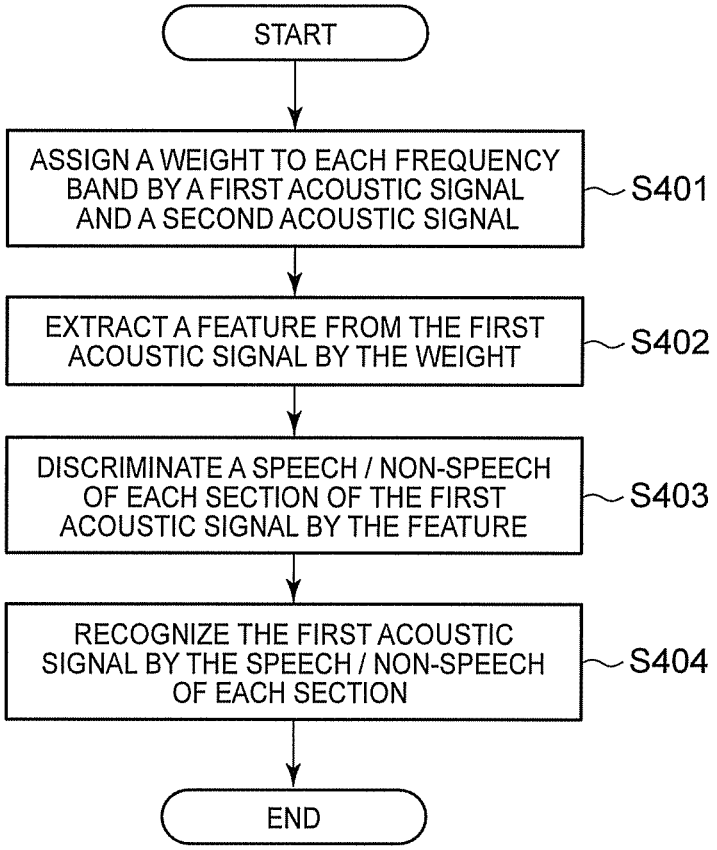
FIG. 3 is a flow chart of processing of the speech discrimination apparatus in FIG. 2.

FIG. 3 is a flow chart of the speech recognition system of the first embodiment. At S401, by using a frequency spectrum of the first acoustic signal d(t) and the second acoustic signal x (t), the weight assignment unit 101 calculates a weight $R_f(t)$ (k: frame number) of each frequency band f, which is used for extraction of a feature by the feature extraction unit 102.

First, the weight assignment unit 101 divides the first acoustic signal d(t) and the second acoustic signal x(t) (acquires at sampling 16000 Hz) into each frame having a length 25 ms (400 samples) and an interval 8 ms (128 samples) respectively. As to this frame division, Hamming Window is used. Next, after setting zero of 112 points to each frame, the weight assignment unit 101 calculates a power spectrum $D_f(k)$ of the first acoustic signal d (t) and a power spectrum $X_f(k)$ of the second acoustic signal x(t) by applying DFT (discrete Fourier transform) of 512 points. As to the power spectrums $D_f(k)$ and $X_f(k)$, the weight assignment unit 101 calculates smoothed power spectrums $D'_f(k)$ and $X'_f(k)$ by smoothing along a time direction with a recursive equation (1).

$$D'_f(k)=\mu\cdot D'_f(k-1)+(1-\mu)\cdot D_f(k)$$

$$X'_f(k)=\mu\cdot X'_f(k-1)+(1-\mu)\cdot X_f(k) \quad (1)$$

In the equation (1), $D'_f(k)$ and $X'_f(k)$ represent a smoothed power spectrum at a frequency band f, and μ represents a forgetting factor to adjust a smoothing degree. μ is approximately set to "0.3~0.5".

Next, by using the smoother power spectrum $D'_f(k)$ of the first acoustic signal, the weight assignment unit 101 assigns a weight "0" to a frequency band not including a main element of the user's speech, and a weight "1" to other frequency bands. Concretely, by comparing the smoothed power spectrum $D'_f(k)$ of the first acoustic signal to a first threshold $TH_D(k)$, the weight is assigned using an equation (2).

$$\text{if } D'_f(k)<TH_D(k) \text{ then } R_f(k)=0 \text{ else } R_f(k)=1 \quad (2)$$

The first threshold $TH_D(k)$ needs to have a value suitable for detection of a frequency band including the user's speech. For example, the first threshold $TH_D(k)$ can be set to a value larger than a frequency spectrum of a silent section (For example, a section of 100 msec immediately after activation) of the first acoustic signal.

Next, by using the smoother power spectrum $X'_f(k)$ of the second acoustic signal, the weight assignment unit 101 detects a frequency band (a main frequency band of disturbance) having a high probability that includes the disturbance sound among frequency bands not including the main element of the user's speech. Concretely, as to the frequency band having "$R_f(k)=0$" as a weighting result by the equation (2), $R_f(k)$ is updated by an equation (3).

$$\text{if } R_f(k)=0 \text{ if } X'i_f(k)\leq TH_X(k) \text{ then } R_f(k)=1 \quad (3)$$

A second threshold can be set to a value larger than a power of silent section of the first acoustic signal. Furthermore, as shown in an equation (4), an average of a frequency spectrum of each frame may be the second threshold.

$$TH_X(k)=\frac{1}{P}\sum_{f=0}^{P-1}X'_f(k) \quad (4)$$

In the equation (4), P represents the number of frequency bands f. In this case, the second threshold dynamically changes for each frame.

Lastly, $R_f(k)$ is "0" or "1". A frequency band having "$R_f(k)=0$" is a main frequency band of disturbance having a high probability that includes not the main element of the user's speech but the disturbance sound.

Moreover, after multiplying a suitable coefficient with the smoother power spectrum $D'_f(k)$ of the first acoustic signal, the weight assignment unit 101 may calculate a power spectrum by subtracting from a smoother power spectrum $X'_f(k)$ of the second acoustic signal, assign a weight "0" to a frequency band having the power spectrum larger than a predetermined threshold, and assign a weight "1" to other frequency bands.

At S402, by using the weight $R_f(k)$ of each frequency band (acquired by the weight assignment unit 101), the feature extraction unit 102 extracts a feature representing the user's speech from the first acoustic signal d(t).

In the first embodiment, an average of a feature (SNR) of each frequency band is calculated by an equation (5). Hereinafter, this average ($SNR_{avrg}(k)$) is called "averaged SNR".

$$SNR_{avrg}(k)=\frac{1}{M(k)}\sum_{f=0}^{P-1}snr_f(k)\cdot R_f(k) \quad (5)$$

$$snr_f(k)=\log_{10}\left(\frac{\mathrm{MAX}(N_f(k),\ D'_f(k))}{N_f(k)}\right)$$

In the equation (5), M(k) represents the number of frequency bands f each of which is discriminated not to be the main frequency band of disturbance at the k-th frame (i.e., $R_f(k)=1$). Furthermore, $N_f(k)$ represents an estimation value of a power spectrum of a disturbance sound included in the first acoustic signal. For example, the estimation value is calculated by averaging power spectrums of 20 frames from the head of the first acoustic signal. In general, the first acoustic signal in a section including a user's speech is larger than the first acoustic signal in a section not including a user's speech.

Accordingly, the larger the averaged SNR is, the higher the probability which the first acoustic signal includes the user's speech is. Moreover, the feature is not limited to the averaged SNR. For example, normalized spectral entropy or an inter-spectral cosine value may be used as the feature.

By using the equation (5), the feature extraction unit 102 extracts a feature by excluding a frequency spectrum in a main frequency band of disturbance ($R_f(k)=1$) specified by the weight assignment unit 101. The main frequency band of disturbance is a frequency band having a high probability which not a main element of the user's speech but the disturbance sound is included. Accordingly, in case of extracting a feature, by excluding a frequency spectrum of the main frequency band of disturbance, the feature including the main element of the user's speech without influence of the disturbance sound can be extracted.

At S403, the speech/non-speech discrimination unit 103 discriminates speech/non-speech of each frame by comparing the feature (extracted by the feature extraction unit 102) to a third threshold $TH_{VA}(k)$, as shown in an equation (6).

$$\text{if } SNR_{avrg}(k) > TH_{VA}(k) \text{ then } k\text{-th frame is speech else } k\text{-th frame is non-speech} \quad (6)$$

At S404, the speech recognition unit 110 specifies a user's speech section (as a recognition target) using a discrimination result of each frame output by the speech discrimination apparatus 100. Furthermore, the speech recognition unit 110 executes speech recognition of the acoustic signal e(t) (In the first embodiment, e(t)=d(t)) output by the speech discrimination apparatus 100.

In above explanation, the power spectrum is used as a frequency spectrum. However, an amplitude spectrum may be used.

(Effect)

As mentioned-above, in the speech discrimination apparatus of the first embodiment, a weight is assigned to each frequency band by using the power spectrum of the first and second acoustic signals. Accordingly, a small weight is not assigned to a frequency band including the main element of the user's speech. As a result, in case of extracting the feature, it is prevented that the frequency band including the main element of the user's speech is excluded.

(The First Modification)

Figure 4:
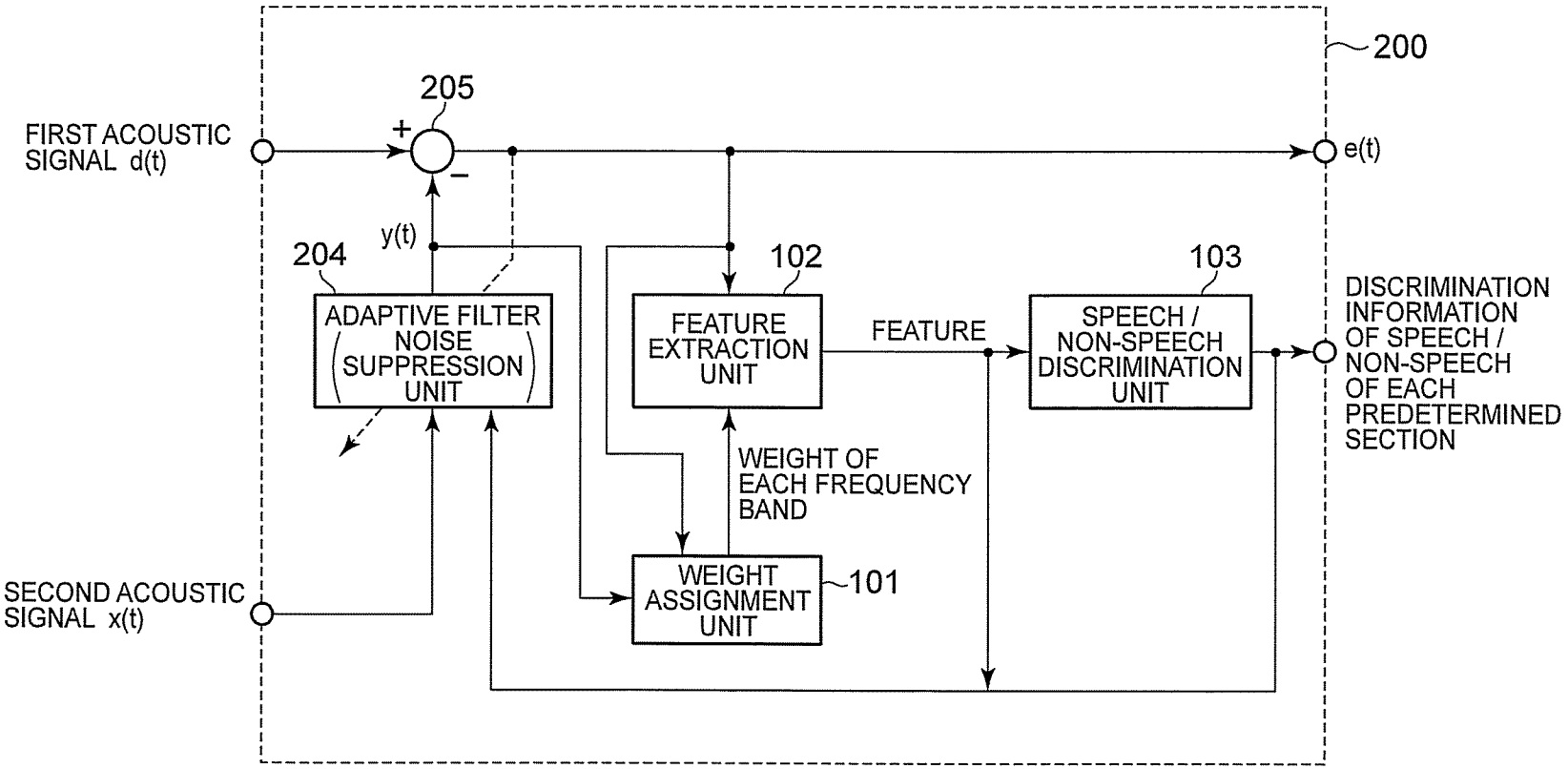
FIG. 4 is a block diagram of the speech discrimination apparatus according to a first modification.

The speech discrimination apparatus 100 of the first embodiment can be replaced with a speech discrimination apparatus 200 explained next. FIG. 4 is a block diagram of the speech discrimination apparatus 200. A unit different from the speech discrimination apparatus 100 is an adaptive filter 204 (a noise suppression unit) to exclude a disturbance sound from the first acoustic signal d(t). In addition to this, the weight assignment unit 101 assigns a weight of each frequency band by using a power spectrum of the first acoustic signal e(t) from which the disturbance sound is excluded, and a power spectrum of a second acoustic signal y(t) with which a filter characteristic of noise-suppression is convoluted. Furthermore, the feature extraction unit 102 extracts a feature from the first acoustic signal e(t).

Figure 5:
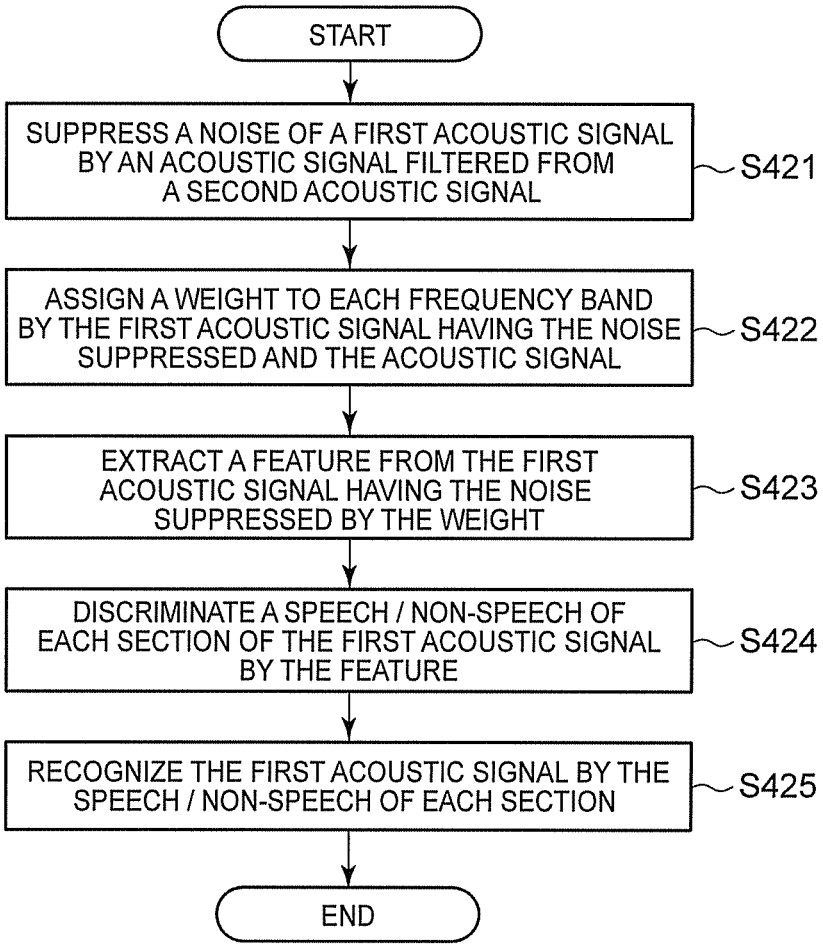
FIG. 5 is a flow chart of processing of the speech discrimination apparatus in FIG. 4.

FIG. 5 is a flow chart of the speech recognition system according to the first modification. A step different from the first embodiment is S421.

At S421, the adaptive filter 204 generates an acoustic signal y(t) to suppress the disturbance sound mixed into d(t) by filtering x(t). A subtractor 205 generates e(t) that suppresses the disturbance sound included in the first acoustic signal by subtracting y(t) from d(t). In this case, e(t) is calculated by an equation (7).

$$\begin{aligned} e(t) &= d(t) - y(t) \\ y(t) &= \sum_{i=0}^{L-1} (w_i(t) \cdot x(t-i)) \\ &= w(t)^T x(t) \\ w(t) &= [w_0(t), w_1(t), \ldots, w_{L-1}(t)]^T \\ x(t) &= [x(t), x(t-1), \ldots x(t-L+1)]^T \end{aligned} \quad (7)$$

In the equation (7), L is the number of filter coefficients of the adaptive filter 204, which is determined by a larger one of a delay time τ1 and an echo time τ2 of usage environment. The delay time τ1 is an interval between a time when a disturbance sound reaches the sub microphone 130-2 and a time when the disturbance sound reaches the main microphone 130-1. Furthermore, a value w of filter coefficients of the adaptive filter 204 is updated by an equation (8), for example, using NLMS algorithm.

$$w(t+1) = w(t) + \frac{\alpha}{x(t)^T x(t) + \gamma} e(t) x(t) \quad (8)$$

In the equation (8), α is a step size to adjust an update speed, and γ is a small positive value to prevent that a denominator term is equal to zero. α is approximately set to "0.1~0.3". In this case, the adaptive filter 204 may control update of filter coefficients by comparing $SNR_{avrg}(k)$ (extracted by the feature extraction unit 102) to a fourth threshold $TH_{DT}$, as shown in an equation (9).

$$\text{if } SNR_{avrg}(k) < TH_{DT}(k) \text{ then update of filter coefficients else non-update of filter coefficients} \quad (9)$$

By the equation (9), the adaptive filter 204 can prevent the filter coefficients from updating at a section in which the first acoustic signal d(t) includes the user's speech.

At S422, based on a power spectrum of the first acoustic signal e(t) (after suppressing noise) and a power spectrum of the second acoustic signal y(t) (after filtering), the weight assignment unit 101 assigns a weight of each frequency band. Processing from S423 to S425 is same as processing from S402 to S404 of the first embodiment. Accordingly, its explanation is omitted.

As mentioned-above, in the first embodiment, the disturbance sound included in the first acoustic signal is suppressed by the adaptive filter 204 (the noise suppression unit). Accordingly, accuracy to discriminate speech/non-speech by the speech discrimination unit 200 rises.

(The Second Embodiment)

Figure 6:
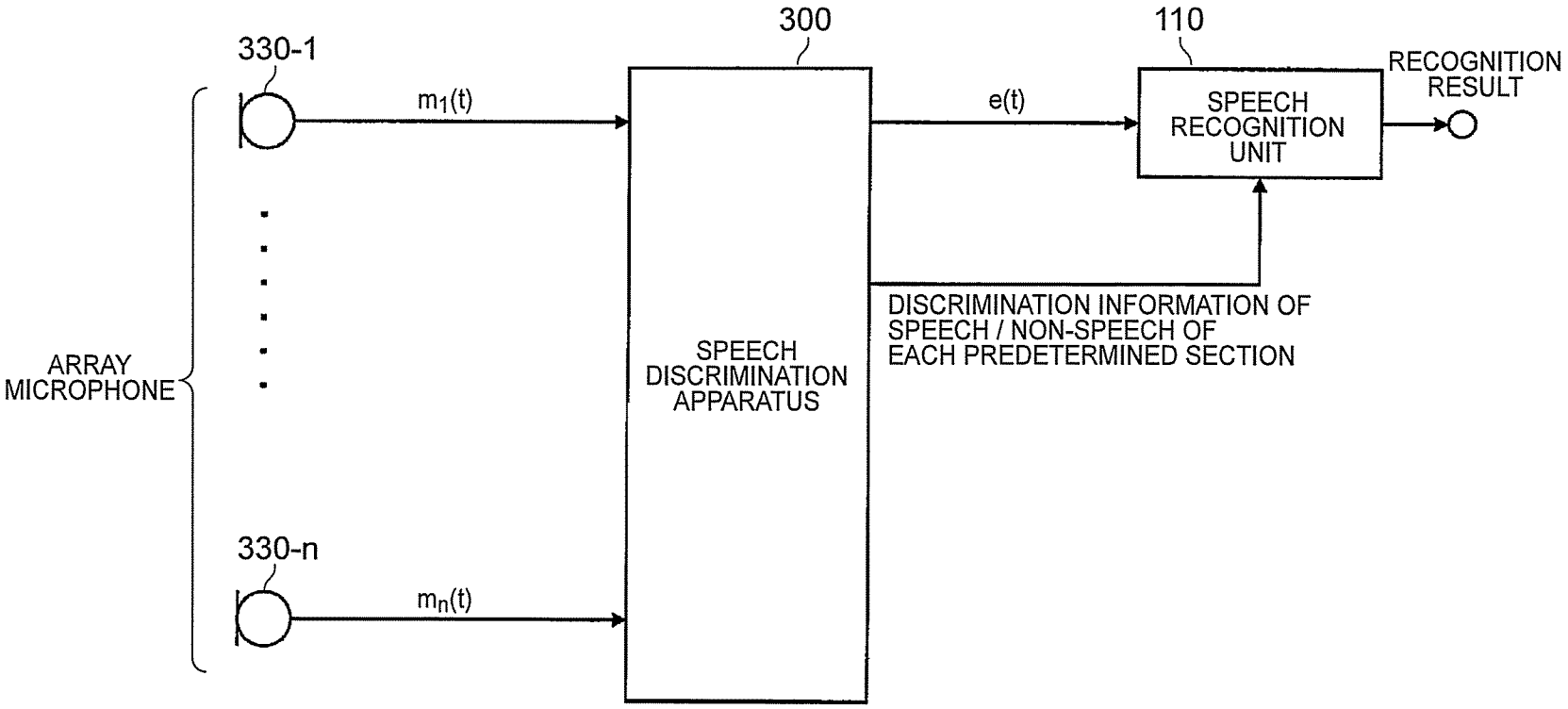
FIG. 6 is a block diagram of the speech recognition system according to a second embodiment.

FIG. 6 is a block diagram of the speech recognition system including a speech discrimination apparatus according to the second embodiment. The speech discrimination apparatus 300 acquires an acoustic signal of n-channels via microphones 330-1~**330-*n***.

Figure 7:
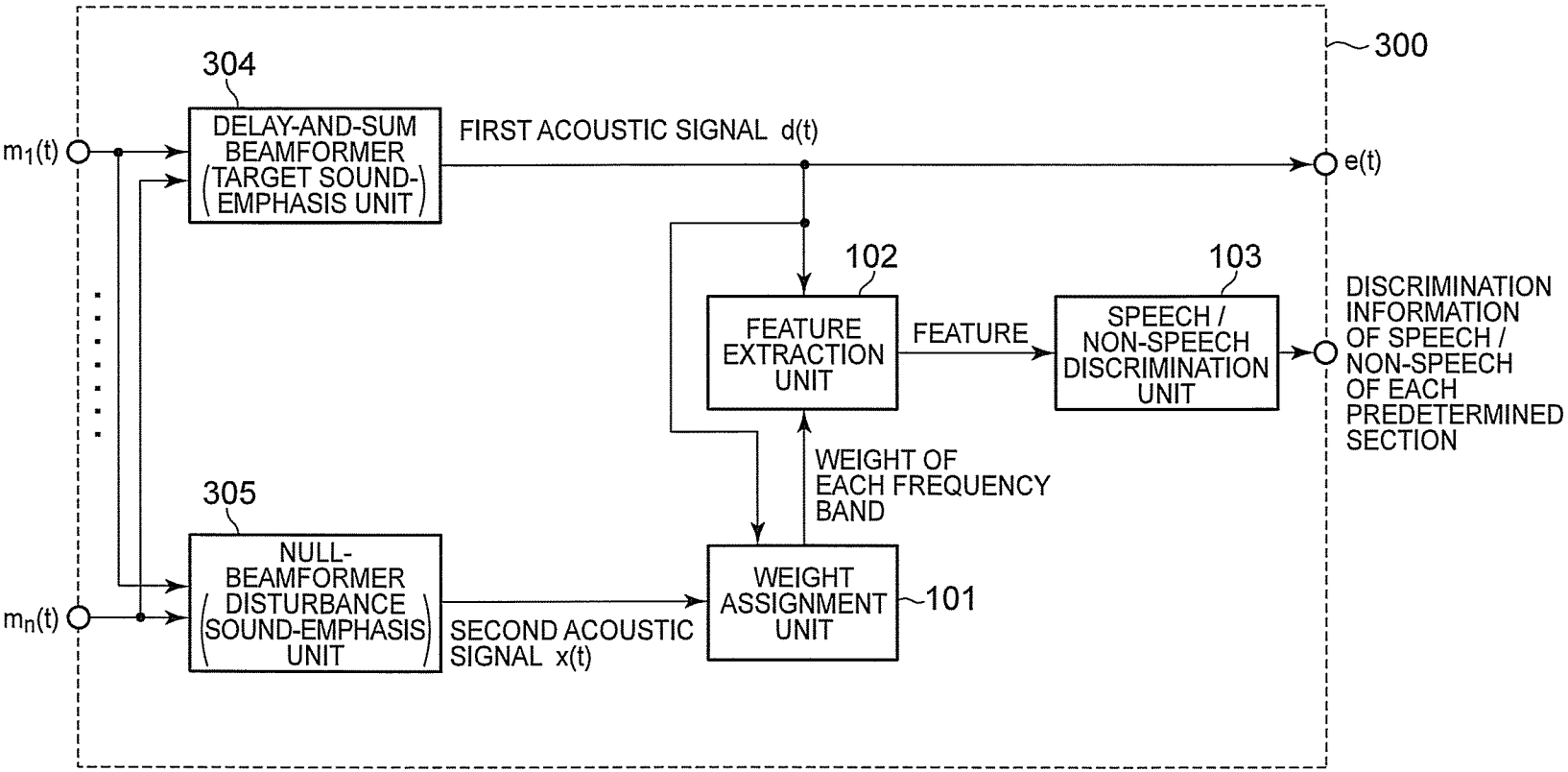
FIG. 7 is a block diagram of the speech discrimination apparatus according to the second embodiment.

FIG. 7 is a block diagram of the speech discrimination apparatus 300. In the speech discrimination apparatus 300, component different from the first embodiment is a delay-and-sum beamformer 304 (target sound-emphasis unit) and a null beamformer 305 (disturbance sound-emphasis unit). The delay-and-sum beamformer 304 executes addition in-phase of acoustic signals $m_1(t)$~$m_n(t)$ of n-channels, and generates a first acoustic signal d(t) including the user's speech mainly. The null beamformer 305 executes subtraction in-phase of acoustic signals $m_1$ (t) and $m_n$ (t) of two channels, and generates a second acoustic signal e(t) including the disturbance sound mainly.

(Flow Chart)

Figure 8:
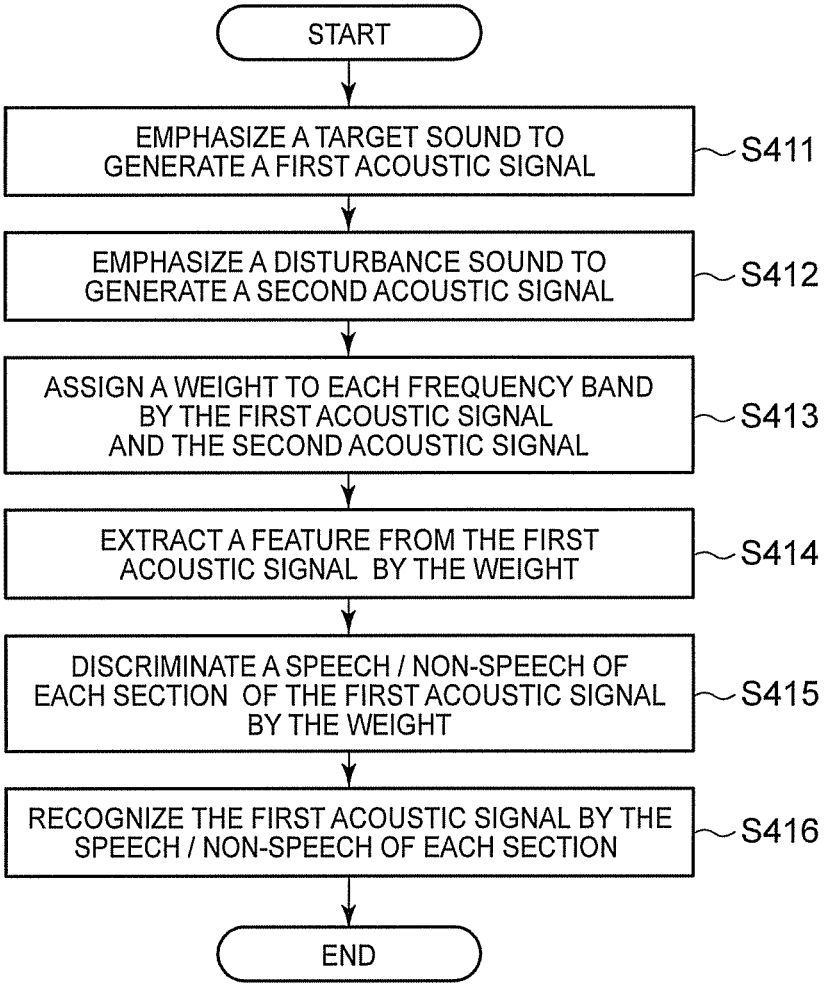
FIG. 8 is a flow chart of processing of the speech discrimination apparatus in FIG. 7.

FIG. 8 is a flow chart of the speech recognition system according to the second embodiment. Steps different from the first embodiment are S411 and S412.

At S411, the delay-and-sum beamformer 304 executes addition in-phase of acoustic signals $m_1$ (t)~$m_n$ (t) of n-channels, and generates the first acoustic signal d(t). Furthermore, the null beamformer 305 executes subtraction in-phase of acoustic signals $m_1$ (t) and $m_n$ (t) of two channels, and generates the second acoustic signal e(t). In this case, if a delay for aligning in-phase to be given to p-th acoustic signal is $D_p$, operation to calculate the first and second acoustic signals is represented as equations (10) and (11) respectively.

$$d(t) = \sum_{p=1}^{n} m_p(t - D_p) \tag{10}$$

$$x(t) = m_1(t - D_1) - m_n(t - D_n) \tag{11}$$

The first acoustic signal d(t) is a signal that acoustic signals $m_1$ (t)~$m_n$ (t) of n-channels are added in-phase, i.e., an output (from the delay-and-sum beamformer) of $m_1$ (t)~$m_n$ (t) which direct toward a direction of aligning in-phase (determined by $D_p$). The direction of aligning in-phase is set to a direction toward the user. The second acoustic signal x(t) is a signal that two acoustic signals $m_1$ (t) and $m_n$ (t) are subtracted in-phase, i.e., an output (from the null beamformer) from which a speech coming from a direction of aligning in-phase is removed. The direction of aligning in-phase is set to above-mentioned direction toward the user. As a result, the first acoustic signal is a signal which emphasizes the user's speech, and the second acoustic signal is a signal which emphasizes the disturbance sound by suppressing the user's sound.

Moreover, the delay $D_p$ for aligning in-phase to be given to p-th acoustic signal should be a value larger than or equal to zero. Because, if the delay is a negative value, $m_p$ (t-$D_p$) represents a signal value (not observed yet) in the future, i.e., causation is failed. Accordingly, by determining the delay $D_p$ with an equation (12), it is guaranteed that the delay $D_p$ is larger than or equal to zero.

$$D_p = \tau 3 + \Delta t_{p-1}$$

$$\tau 3 = \max(-(\Delta t_{p-1}))$$

$$\Delta t_{p-1} = t_p - t_1 \tag{12}$$

Assume that a time when the user's speech coming from the direction of aligning in-phase reaches p-th microphone 330-*p* is $t_p$. A difference $\Delta t_{o-1} = t_p - t_1$ between two reach times based on the first microphone 330-1 can be calculated using a chart. In order to most simplify, the delay $D_p$ for aligning in-phase to be given to p-th channel signal is represented as $\Delta t_{p-1}$. However, if $\Delta t_{p-1}$ is a negative value, the above-mentioned causation is failed. Accordingly, any offset should be given. If this offset is represented as τ3, a value of τ3 can be given as maximum of $-(\Delta t_{p-1})$.

Moreover, in the second embodiment, the first acoustic signal d(t) output from the delay-and-sum beamformer (as it is) is used as e (t) to be output from the speech discrimination apparatus 300. Furthermore, processing from S413 to S416 is same as processing from S401 to S404 of the first embodiment. Accordingly, its explanation is omitted.

As mentioned-above, in the speech discrimination apparatus 300 of the second embodiment, by array-processing using a plurality of acoustic signals, the first acoustic signal including the user's speech and the second acoustic signal including the disturbance sound are generated. Accordingly, a restriction of the location relationship between two microphones in the first embodiment, i.e., the sub microphone is relatively located at a position farer than the main microphone from the user, can be removed.

(The Second Modification)

Figure 9:
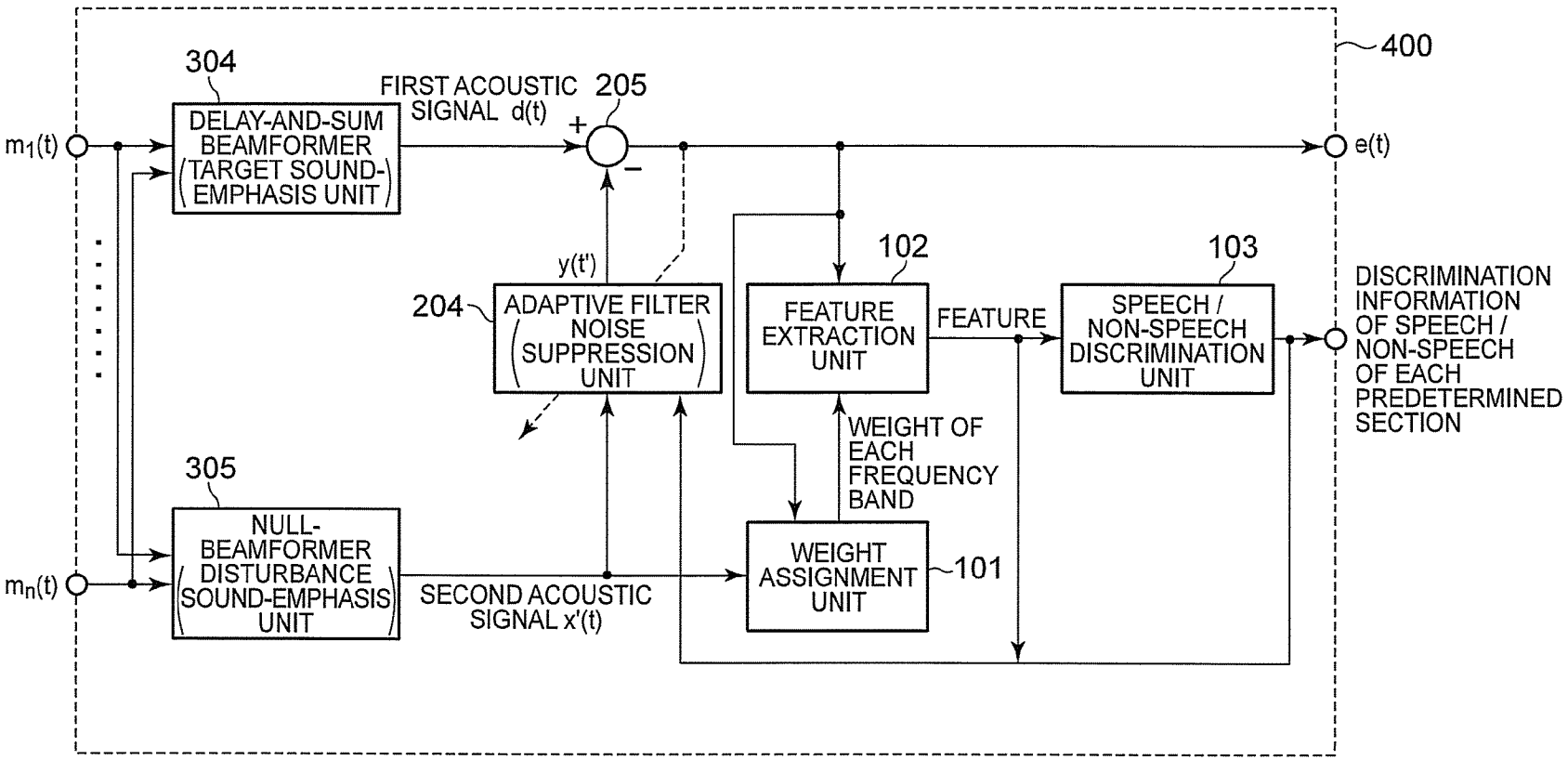
FIG. 9 is a block diagram of the speech discrimination apparatus according to a second modification.

The speech discrimination apparatus 300 of the second embodiment can be replaced with a speech discrimination apparatus 400 explained next. FIG. 9 is a block diagram of the speech discrimination apparatus 400. In the speech discrimination apparatus 400, component different from the speech discrimination apparatus 300 is the adaptive filter 204 (noise suppression unit) to exclude the disturbance sound from the acoustic signal (output from the delay-and-sum beamformer 304).

Figure 10:
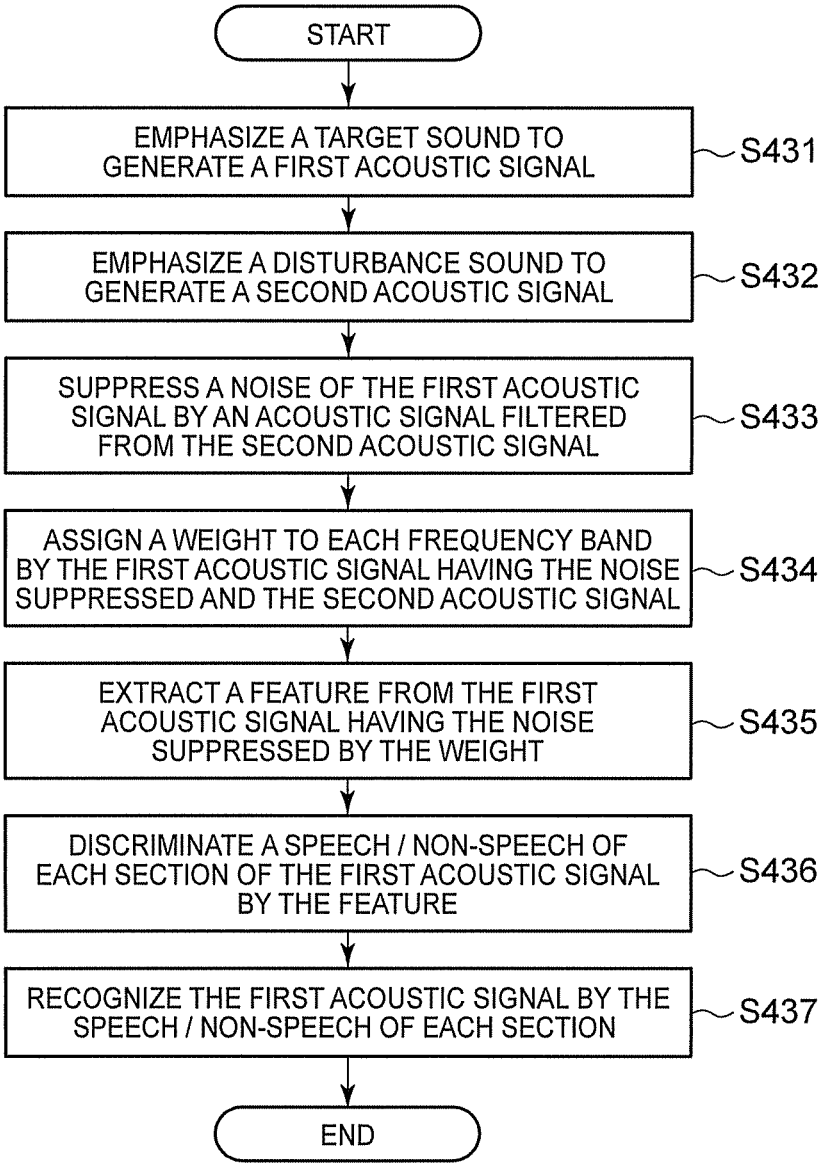
FIG. 10 is a flow chart of processing of the speech discrimination apparatus in FIG. 9.

FIG. 10 is a flow chart of the speech recognition system according to the second modification. In FIG. 10, processing different from the second embodiment is S433.

At S433, the adaptive filter 204 generates an acoustic signal y(t) by filtering the second acoustic signal x(t) (output from the null beamformer 305). Then, the subtractor 205 subtracts y(t) from the first acoustic signal d(t) (output from the delay-and- sum beamformer 304). As a result, the disturbance signal included in the first acoustic signal d(t) is suppressed. An acoustic signal e(t) in which the disturbance signal is suppressed by the adaptive filter 204 is calculated by an equation (13).

$$e(t) = d(t - \tau 4) - y(t) \tag{13}$$

$$y(t) = \sum_{i=0}^{L-1} (w_i(t) \cdot x(t - i)) = w(t)^T x(t)$$

$$w(t) = [w_0(t), w_1(t), \ldots, w_{L-1}(t)]^T$$

$$x(t) = [x(t), x(t-1), \ldots x(t - L + 1)]^T$$

In the equation (13), an element of x(t) included in d(t) precedes or delays for x(t). In order to prevent failure of causation by this precedence, τ4 in the equation (13) is given as a delay to d(t). Assume that a time to propagate a sound wave on a distance from the center of gravity in microphones (of n units) dispersedly located to one microphone thereof most remotely from the center of gravity is Tmax. A value of τ4 is 2 Tmax. As to a time when the sound wave reaches each microphone, based on a time when the same sound wave reaches the center of gravity, delay of ±Tmax (negative value is precedence) occurs. Briefly, between a signal via a microphone which a sound wave has reached first and a signal via another microphone which the sound wave has reached last, an element of the sound wave delays at the maximum 2 Tmax. Accordingly, by delaying d(t) as τ4 (=2 Tmax), the element of x(t) included in d(t) certainly delays for x(t). As a result, failure of the causation can be prevented.

The number (L) of filter coefficients of the adaptive filter 204 is determined by the sum of a maximum precedence time τ4 and an echo time τ2 of usage environment. Moreover, update (and update-control) of filter coefficients w of the adaptive filter 204 is performed in the same way as the equations (8) and (9) operated by the speech discrimination apparatus 200.

By above-mentioned processing, filter coefficients to minimize e (t) not including the user's speech can be calculated. As a result, the disturbance sound mixed into d(t) is smaller than a disturbance sound processed by the speech discrimination apparatus 300.

At S434, based on power spectrums of the first acoustic signal e(t) (after suppressing noise) and the second acoustic signal x(t) output from the null beamformer 305 (the disturbance sound emphasis unit), the weight assignment unit 101 assigns a weight to each frequency band. Processing from S435 to S437 is same as processing from S402 to S404 of the first embodiment. Accordingly, its explanation is omitted.

In this way, in the second modification, a disturbance sound included in the first acoustic signal is suppressed by the adaptive filter 204 (the noise suppression unit). Accordingly, accuracy to discriminate speech/non-speech by the speech discrimination apparatus 400 rises.

(The Third Embodiment)

Figure 11:
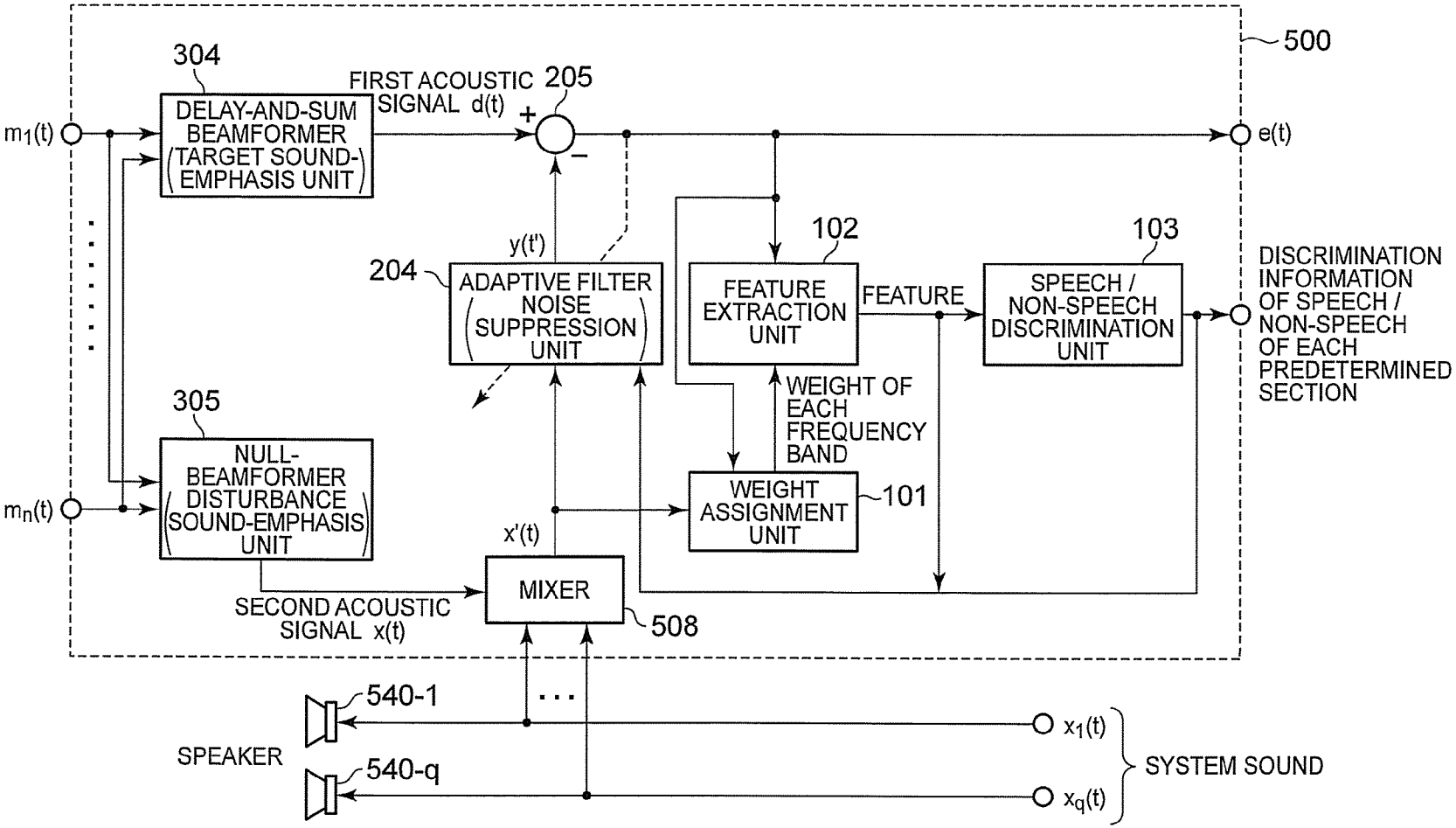
FIG. 11 is a block diagram of the speech discrimination apparatus according to a third modification.

The speech discrimination apparatus 300 of the second embodiment can be replaced with a speech discrimination apparatus 500 in FIG. 11. In this component, in addition to the speech discrimination apparatus 400 of the second modification, a mixer 508 to mix a system sound into the second acoustic signal x(t) is further included. The speech discrimination apparatus 500 is improved so as to cope with a case that a system sound loudly output from the speaker mixes into the first acoustic signal as a disturbance sound (echo).

The mixer 508 generates an acoustic signal x'(t) by mixing the second acoustic signal x(t) and system sounds $x_1(t)$~$x_q(t)$ with an equation (14).

$$x'(t) = \beta_1 \cdot \left( (1 - \beta_2) z(t) + \beta_2 \sum_{i=1}^{q} x_i(t) \right) \tag{14}$$

In the equation (14), $\beta_1$ is a coefficient to determine a gain of whole x' (t), and $\beta_2$ is a coefficient to determine a ratio to mix x(t) and the system sound. This mixture processing is executed at S433 in FIG. 10.

Update (and update-control) of filter coefficients w of the adaptive filter 204 is performed in the same way as the equations (8), (9) and (13) operated by the speech discrimination apparatuses 200 and 400. As a result, the filter coefficients to make e(t) (not including the user's speech) be small can be calculated, and the disturbance sound mixed into e(t) can be suppressed.

Moreover, if $\beta_2$ in the equation (14) is set to "0", the speech discrimination apparatus 500 functions in the same way as the speech discrimination apparatus 400. Furthermore, if $\beta_2$ is set to "1", the adaptive filter 204 and the subtractor 205 operates to suppress an acoustic echo of the system sound from the first acoustic signal d(t). When a surrounding environment is silent, a main element of the disturbance sound becomes the acoustic echo. Accordingly, setting of the latter case had better be selected.

(The Fourth Modification)

In the first and second embodiments, the weight assignment unit 101 assigns a weight "0" to the main frequency band of disturbance, and a weight "1" to other frequency bands. However, the weight is not limited to above-mentioned example. For example, by assigning a weight "−100" to the main frequency band of disturbance and a weight "100" to other frequency bands, when the feature extraction unit 102 extracts a feature, a frequency spectrum of the frequency band to which weight "−100" is assigned maybe excluded. Furthermore, the weight (used for extraction of the feature) may be continuously changed.

(Effect)

As to the speech discrimination apparatus of at least one of above-mentioned embodiments and modifications, the weight is assigned to each frequency band by using power spectrums of the first and second acoustic signals. Accordingly, it is prevented that a small weight is assigned to a frequency band including a main element of the user's speech. As a result, when the feature is extracted, it is prevented that the frequency band (including the main element of the user's speech) is excluded.

In the disclosed embodiments, the processing can be performed by a computer program stored in a computer-readable medium.

In the embodiments, the computer readable medium may be, for example, a magnetic disk, a flexible disk, a hard disk, an optical disk (e.g., CD-ROM, CD-R, DVD), an optical magnetic disk (e.g., MD). However, any computer readable medium, which is configured to store a computer program for causing a computer to perform the processing described above, may be used.

Furthermore, based on an indication of the program installed from the memory device to the computer, OS (operation system) operating on the computer, or MW (middle ware software), such as database management software or network, may execute one part of each processing to realize the embodiments.

Furthermore, the memory device is not limited to a device independent from the computer. By downloading a program transmitted through a LAN or the Internet, a memory device in which the program is stored is included. Furthermore, the memory device is not limited to one. In the case that the processing of the embodiments is executed by a plurality of memory devices, a plurality of memory devices may be included in the memory device.

A computer may execute each processing stage of the embodiments according to the program stored in the memory device. The computer may be one apparatus such as a personal computer or a system in which a plurality of processing apparatuses are connected through a network. Furthermore, the computer is not limited to a personal computer. Those skilled in the art will appreciate that a computer includes a processing unit in an information processor, a microcomputer, and so on. In short, the equipment and the apparatus that can execute the functions in embodiments using the program are generally called the computer.

While certain embodiments have been described, these embodiments have been presented by way of examples only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An apparatus for discriminating speech/non-speech of a first acoustic signal, comprising:

a memory to store computer executable instructions;

a processor configured to execute the computer executable instructions to perform operations comprising:

assigning a weight to each, frequency band, based on both a frequency spectrum of the first acoustic signal including a user's speech and a frequency spectrum of a second acoustic signal including a disturbance sound, wherein the first acoustic signal is acquired via a main microphone, and the second acoustic signal is acquired via a sub microphone located at a position farther than the main microphone from the user;

extracting a feature from the frequency spectrum of the first acoustic signal, based on an updated weight of each frequency band; and discriminating speech/non-speech of the first acoustic signal, based on the feature, wherein, the assigning assigns a first weight to a frequency band in which the frequency spectrum of the first acoustic signal is smaller than a first threshold, assigns a second weight larger than the first weight to frequency bands in which the frequency spectrum of the first acoustic signal is not smaller than the first threshold, and updates the first weight already assigned to the frequency band in which the frequency spectrum of the second acoustic signal is not larger than a second threshold, to the second weight, the extracting extracts the feature by excluding frequency spectrums of the frequency band to which the first weight is assigned.

2. The apparatus according to claim 1, the operations further comprising:

suppressing a noise included in the first acoustic signal, based on the second acoustic signal;

wherein the assigning utilizes the frequency spectrum of the first acoustic signal in which the noise is suppressed.

3. The apparatus according to claim 2, the operations further comprising:

extracting the first acoustic signal in which the user's sound is emphasized by processing acoustic signals of a plurality of channels; and extracting the second acoustic signal in which the disturbance sound is emphasized by processing at least two of the acoustic signals;

wherein the suppressing suppresses the noise included in the first acoustic signal extracted, based on the second acoustic signal extracted.

4. The apparatus according to claim 1, the operations further comprising:

extracting the first acoustic signal in which the user's sound is emphasized by processing acoustic signals of a plurality of channels; and extracting the second acoustic signal in which the disturbance sound is emphasized by processing at least two of the acoustic signals;

wherein the assigning utilizes the frequency spectrum of the first acoustic signal extracted and the frequency spectrum of the second acoustic signal extracted.

5. The apparatus according to claim 1, the operations further comprising:

mixing a system sound into the second acoustic signal;

wherein the assigning utilizes the frequency spectrum of the second acoustic signal in which the system sound is mixed.

6. A method for discriminating speech/non-speech of a first acoustic signal, comprising:

assigning a weight to each frequency band, based on both a frequency spectrum of the first acoustic signal including a user's speech and a frequency spectrum of a second acoustic signal including a disturbance sound, wherein the first acoustic signal is acquired via a main microphone, and the second acoustic signal is acquired via a sub microphone located at a position farther than the main microphone from the user;

extracting a feature from the frequency spectrum of the first acoustic signal, based on an updated weight of each frequency band; and discriminating speech/non-speech of the first acoustic signal, based on the feature, wherein, the assigning includes assigning a first weight to a frequency band in which the frequency spectrum of the first acoustic signal is smaller than a first threshold, assigning a second weight larger than the first weight to frequency bands in which the frequency spectrum of the first acoustic signal is not smaller than the first threshold, and updating the first weight already assigned to the frequency band in which the frequency spectrum of the second acoustic signal is not larger than a second threshold, to the second weight, the extracting includes extracting the feature by excluding frequency spectrums of the frequency band to which the first weight is assigned.

7. A non-transitory computer readable medium storing instructions thereon, that when executed by a processor, perform operations for discriminating speech/non-speech of a first acoustic signal, the operations comprising:

assigning a weight to each frequency band, based on both a frequency spectrum of the first acoustic signal including a user's speech and a frequency spectrum of a second acoustic signal including a disturbance sound, wherein the first acoustic signal is acquired via a main microphone, and the second acoustic signal is acquired via a sub microphone located at a position farther than the main microphone from the user;

extracting a feature from the frequency spectrum of the first acoustic signal, based on an updated weight of each frequency band; and discriminating speech/non-speech of the first acoustic signal, based on the feature, wherein, the assigning includes assigning a first weight to a frequency band in which the frequency spectrum of the first acoustic signal is smaller than a first threshold, assigning a second weight larger than the first weight to frequency bands in which the frequency spectrum of the first acoustic signal is not smaller than the first threshold, and updating the first weight already assigned to the frequency band in which the frequency spectrum of the second acoustic signal is not larger than a second threshold, to the second weight, the extracting includes extracting the feature by excluding frequency spectrums of the frequency band to which the first weight is assigned.

* * * * *